United States Patent [19]

Adachi

[11] 4,141,095

[45] Feb. 27, 1979

[54] ELECTRONIC CRADLE

[76] Inventor: Kouji Adachi, 1048, Fuchinobe, Sagamihara-shi, Kanagawa-ken, Japan

[21] Appl. No.: 857,768

[22] Filed: Dec. 5, 1977

Related U.S. Application Data

[63] Continuation-in-part of Ser. No. 694,195, Jun. 9, 1976, abandoned.

[51] Int. Cl.[2] ..... A47D 9/04

[52] U.S. Cl. ..... 5/108; 5/101; 297/260; 297/377

[58] Field of Search ..... 5/105, 108, 109; 297/274, 377, 457, 260

[56] References Cited

U.S. PATENT DOCUMENTS

| | | | |
|---|---|---|---|
| 3,235,306 | 2/1966 | Chernivsky | 297/457 |
| 3,351,380 | 11/1967 | Sprague | 297/377 |
| 3,463,504 | 8/1969 | Petry et al. | 297/377 |
| 3,851,343 | 12/1974 | Kinslow, Jr. | 5/109 |
| 3,952,343 | 4/1976 | Wong | 5/109 |

*Primary Examiner*—Casmir A. Nunberg
*Attorney, Agent, or Firm*—Michael J. Striker

[57] ABSTRACT

A rocking cradle is provided. The cradle includes a support having a limitedly elastically vertically displaceable pivot, a cradle body adapted to hold a baby having a center of gravity in a predetermined position, the cradle body being mounted on the pivot with the center of gravity being above the pivot, and a rocking mechanism remote from the pivot and connected between the cradle body and the support for oscillating the cradle body on the pivot.

13 Claims, 5 Drawing Figures

FIG. 4
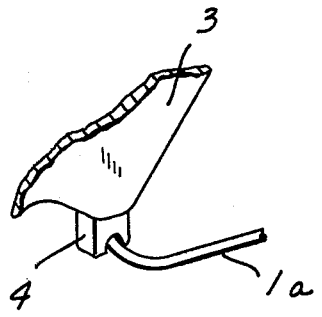
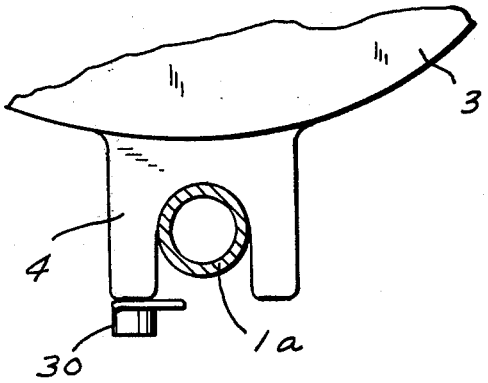
FIG. 5

ELECTRONIC CRADLE

CROSS-REFERENCE TO RELATED APPLICATION

This application is a continuation-in-part of my copending patent application 694,195 filed June 9, 1976 now abandoned.

BACKGROUND OF THE INVENTION

The present invention relates to a rocking cradle for an infant. More particularly this invention concerns such a cradle provided with a motor or the like for rocking the infant held in the cradle.

Conventionally, a baby cradle is hand-rocked. Usually, a baby buggy is also rocked by hand or by moving the buggy. Since conventional cradles are generally rocked manually rather than automatically, the cradle is generally not being rocked at a particular moment when a baby is crying.

Some conventional rocking cradles have the disadvantage that most of the weight of the cradle body and the baby must be bourne by the rocking means. Consequently a much larger force must be applied to rock the cradle and the rocking motion is generally not very smooth because of the large amount of force utilized.

Any movement of the baby must also be absorbed by the rocking means, thereby adding a further load which must be carried by the rocking means. The unpredictability of such movement makes it difficult to absorb such movement while maintaining smooth rocking motion.

SUMMARY OF THE INVENTION

An object of this invention is to provide an improved cradle.

Accordingly, it is a feature of the present invention to provide an electronic cradle in which a baby is rocked as soon as he cries, his voice being detected by a microphone, and the vibrations of the received voice being changed into electronic signals, which drive a motor.

It is another feature of the present invention to provide a cradle having a motor which can be driven within predetermined time periods by a time control means.

It is another feature of the present invention to provide an electronic cradle which can be rocked manually at a predetermined time irrespective of any crying of a baby, the cradle having an automatic switch which can be deactivated and converted into a manual switch.

It is another feature of the present invention to provide an electronic cradle including a tape recorder which plays selected music while the cradle is rocked.

It is another feature of the present invention to provide an electronic cradle which a baby can learn to rock himself by making vocal sounds.

It is still a further feature of the present invention to provide an automatically operating electronic cradle which a child can rock by changing the automatic operation to a manual operation.

Other objects, features and advantages of the invention will appear more fully from the following description.

In accordance with the invention a pipe-shaped arm is provided to connect the cradle body to a platform base upon which rocking means is located. The pipe-shaped arm has the effect of a resilient spring. This spring-like arm acts to absorb the motion of a restless baby so that this motion does not further stress the rocking means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 4 is a perspective view of a magnified portion of an embodiment of the invention showing the relationship of the platform arm to the pivot and the cradle body; and FIG. 5 is a front view of an embodiment of the invention of FIG. 4 and also showing the linkage of a locking member to the pivot.

DETAILED DESCRIPTION OF THE INVENTION

An embodiment of an electronic cradle according to the present invention will now be described with reference to the accompanying drawings.

Figure 1:
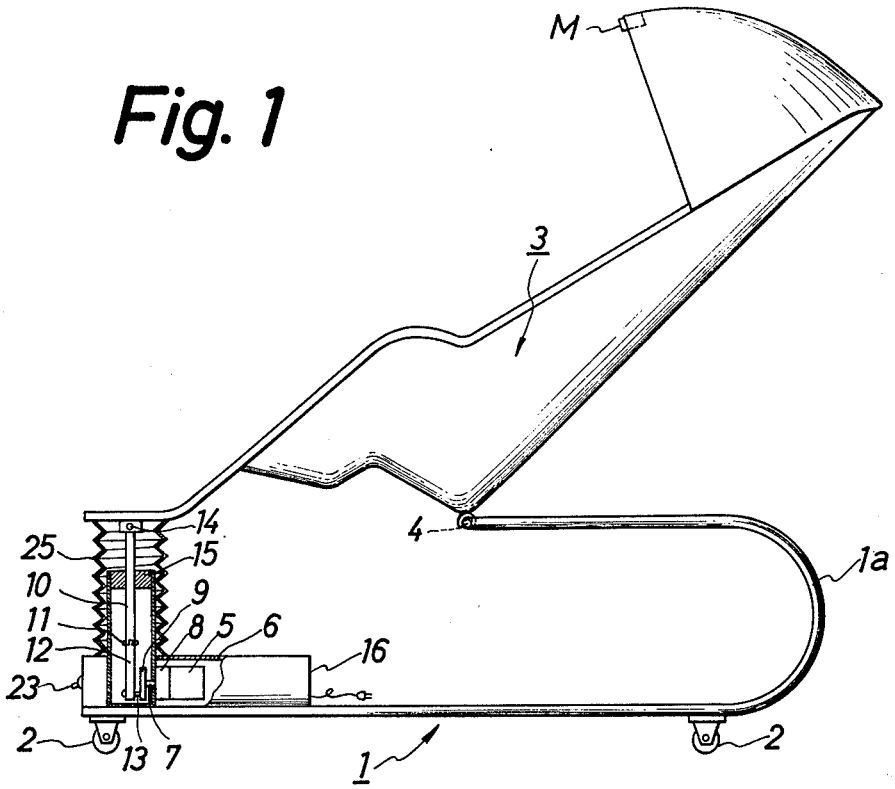
FIG. 1 is a partially cutaway side view of an embodiment of an electronic cradle according to the present invention.

As shown in FIG. 1, numeral 1 denotes a base having casters 2 to which are installed known wheel stopper means or brakes. Numeral 3 denotes a body of the cradle which slopes upwardly from the front side to the rear side. The top and bottom ends of the central lower part of the body 3 are rotatably linked with an arm la of the platform 1 by way of pivots 4. Numeral 5 denotes a motor which is mounted in a frame 6 on the platform 1.

An output or drive shaft 7 is rotated by a reduction gear 8 which is actuated by the motor 5. A rotating plate 9 is fixed to the output shaft 7. Numeral 10 denotes a rod oscillating in a vertical plane, the rod being linked at its bottom end by pin 11 to an interconnecting rod 12.

A lower end of the interconnecting rod 12 is rotatably linked with a peripheral part of the rotating plate 9, by way of a pin 13 while a top end of the up-and-down moving rod 10 is linked with the underside of the front part of the body 3 by way of a pivot 14. That is, the top of the vertically moving rod 10 is rotatable because of the presence of the pivot 14, while the top of the interconnecting rod 12 is rotatable because of the presence of the pin 11. Further, a part of the vertically moving rod 10 is secured by a guide 15 in order to make the stroke smooth. The moving rod 10 imparts a vertically directed rocking motion to the cradle body 3 which then tilts in the lengthwise direction of the cradle body back and forth as the front portion of the cradle body 3 is raised. In its preferred embodiment, the moving rod 10 and the interconnecting rod 12 together have a length which is only about 20–25% of the length of the cradle body 3.

In an alternate embodiment, rod 10 and rod 12 together have a length between 10–34% of the length of the cradle body 3.

Figure 3:
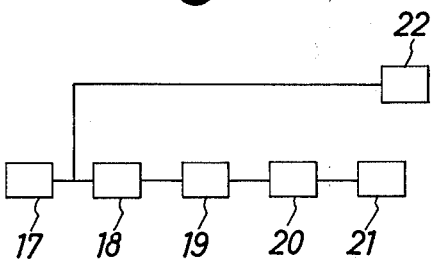
FIG. 3 is a block diagram of an electronic circuit of the embodiment of FIG. 1.

Numeral 16 denotes a box for housing the electronic means mounted on the platform 1. As shown in FIG. 3, the electronic means includes a detection circuit 17, an amplifier 18, a Schmidt circuit 19, a time control means 20, and a relay circuit 21 or the like.

Figure 2:
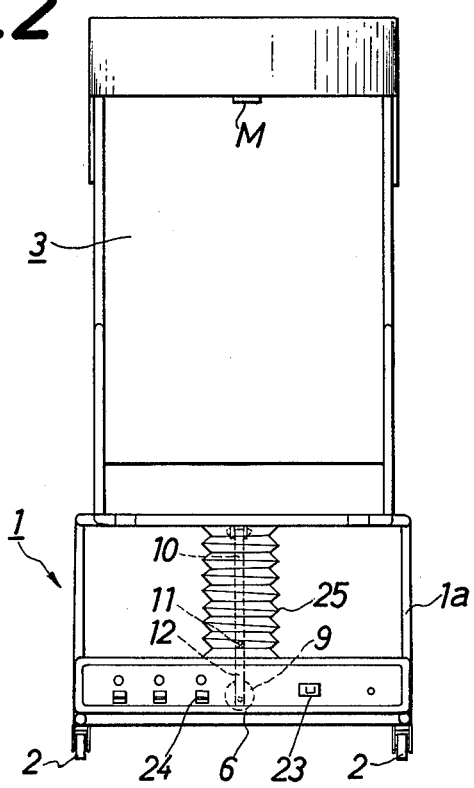
FIG. 2 is a front view of the embodiment of FIG. 1.

A microphone M is placed at the top rear part of the cradle body 3. The microphone is connected to the detection circuit 17, a power source 22 and a motor 5. At the front part of the platform 1 is a manual switch 23 and a switch 24 (FIG. 2) for converting a manual rocking operation into an automatic one. A tape recorder is advantageously located within the box 16 for electronic means, the tape recorder being connected to the motor 5 via circuit 21. For safety purposes, an extensible bellows 25 is provided in order to keep fingers and other objects foreign to the rocking mechanism away from the moving parts which include the rod 10. Therefore, a child cannot touch the moving parts of the rocking mechanism and thereby endanger his safety.

As soon as a baby cries, its voice is received by the microphone m and the vocal vibrations are detected by the detection circuit 17. Then, signals of detection signals are controlled by the Schmidt circuit 19, and a reed-type relay 21 is actuated by output signals of the Schmidt circuit 19. Subsequently, an electric charge is discharged to a time control condenser of the time control means 20. When electric voltage of the time control condenser 26 reaches a given rate, a power supply relay of the relay circuit is closed by the discharged current. Then power is fed to the motor 5, and the motor 5 is driven. Simultaneously, the tape recorder connected to the motor 5 is actuated and the recorded tape is played. As the motor 5 is driven, the rotating plate 9 is rotated by the output shaft 7, and the interconnecting rod 12 moves the vertically moving rod 10 up and down. Therefore, the cradle body 3 rocks up and down by way of the pivot 4.

The motor 5 can be actuated also by switching off the automatic switch and switching on the manual switch so as to rock the cradle without reliance on the detection circuit 17, and the recorded tape can he played simultaneously with the manual rocking.

In another embodiment, a left-and-right movement of the cradle body 3 can be arranged simply by changing the orientation of the pivot 4. Further, the up-and-down movement and the left-and-right movement can be successively actuated.

FIG. 4 shows an embodiment in which the arm 1*a* is curved and enters a U-shaped cavity formed in the pivot 4 which is connected to the cradle body 3. Preferably, the arm 1*a* is a hollow metal pipe which connects the cradle body 3 to base 1*a* and which is limitedly elastic and vertically displaceable. Preferably, arm 1*a* support at least most of the weight of the cradle body, and more preferably arm 1*a* supports substantially all of the cradle body weight, so as to minimize the load burden on the rocking mechanism 5, 7, 8, 10, 11, 12, 13, 14. Arm 1*a* can be unitarily connected to base 1*a* or can be integrally formed with the platform 1*a* and then bent with a U-bend so as to cover at least a portion of the platform 1 and thereby to produce a spring-like effect of arm 1*a*. Because arm 1*a* supports at least most of the weight of the cradle body in the preferred embodiment, less stress is put upon the motor 5 and a more consistent gentle rocking motion can be imparted to the cradle body 3.

Preferably the center of gravity of the cradle body 3 is pivotally linked via pivot 4 to the extending free end of the arm l*a*. Because the center of gravity of the cradle body is so supported, smooth rocking motion is imparted to the cradle body with a slight force from the motor 5.

The center of gravity of a baby in the cradle is over the pivot, the center of gravity oscillating about the pivot as the cradle tilts back and forth.

The pivot 4 is preferably formed integral with the cradle body 3 at its seat portion. Both the pivot and the cradle body are preferably plastic.

As shown in FIG. 5, a safety locking mechanism 30, which is itself per se known, is fixed to the pivot 4 so as to prevent undesired rocking of the cradle body 3. The preferably circular arm 1*a* fits tightly into the cavity or recess formed into the pivot 4, and the pivot 4 slides over the periphery of circular arm l*a* during the rocking of the cradle body. The arm l*a* acts to support the weight of the cradle body and is arranged so that it has a resilient spring-like operation which absorbs restless motion of a baby while the motor 5 continues to impart a substantially constantly consistent and gentle rocking force to the cradle body.

In a further embodiment of the invention shown in FIG. 1, the pivot 4 is a roller fixed to the arm 1*a* and upon which the cradle body 3 rolls. In this embodiment the center of gravity is always located directly above the roller 4 even when the cradle body tilts forward or backward.

In its preferred embodiment, the cradle body 3 is linked indirectly with the platform 1 by way of the pivot 4; according to FIG. 1 the central lower part of the body 3 is linked by way of pivot 4 directly with the arm 1*a* of the platform 1. Rocking means 5, 7, 8, 9, 10, 11, 12, 13, 14 for rocking the body 3 are linked with the body 3 at a position distant from the pivot.

An advantage of the inventive electronic cradle is the performance of various functions for taking sufficient care of a baby living in the cradle body.

It will be understood that each of the elements described above, or two or more together, may also find a useful application in other types of an electronic cradle, differing from the types described above.

While the invention has been illustrated and described as embodied in an arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A rocking cradle comprising in combination: a support having a limitedly elastically vertically displaceable pivot; a cradle body shaped to hold a baby having a center of gravity in a predetermined position with said center of gravity above said pivot; and rocking means remote from said pivot and connected between said cradle body and said support for oscillating said cradle body on said pivot, said rocking means comprising a vertically oscillating rod lying on an upright axis and having a top and a bottom end, a motor having a rotatable drive shaft, and means connecting said motor and the bottom end of said rod for converting rotary motion of a drive shaft into longitudinal motion for vertically oscillating said rod, said cradle body having a top head portion, an intermediate seat portion and a bottom foot portion, said foot portion being fixed to the top end of said rod, said foot portion oscillating about a location which is located in a common approximately horizontal plane perpendicular to said rod, whereby said cradle body is tilted about said pivot.

2. The cradle of claim 1, said cradle body being normally in a central position with said center of gravity substantially directly above said pivot, said center of gravity oscillating to either side of said pivot as said rocking means oscillates said cradle body.

3. The cradle of claim 1, said support including a hollow metal arm having two ends, one end being connected to said pivot.

4. The cradle of claim 1, said support further including a base substantially perpendicular to said vertical axis and a bight section having two ends, one connected to said base and the other connected to the other end of said hollow arm so as to form a substantially U-shaped support above which is the center of gravity of a baby held in said body, whereby said hollow arm resiliently absorbs movement of a baby lying in the cradle body.

5. The cradle of claim 4, said hollow arm extending substantially parallel to said base, at least when said hollow arm is unstressed by the weight of a baby, and being 37 - 47% of the length of said base, said ends of said bight being spaced apart by a distance substantially equal to the length of said rod.

6. The cradle of claim 1, said pivot being a roller.

7. The cradle of claim 1, further comprising voice detecting means connected to said rocking means for automatically activating said rocking means in response to detection of a voice, a settable timing control means connected to said rocking means and operable for activating said rocking means after expiration of a predetermined period of time, tape playing means connected to said rocking means for playing music while said rocking means is in operation, and a manual switch connected to said rocking means and said tape playing means for manually activating the same.

8. The cradle of claim 1, said foot portion always being lower than said head portion; said pivot being connected to said seat portion and having a recess adapted to engage said hollow arm; said arm being positioned so as to support most of the weight of the cradle body; said converting means further comprising a reduction gear intermediate said drive shaft and said motor, a rotatable plate fixed to said drive shaft for joint rotation therewith, and a first pin connected to a peripheral portion of said rotatable plate and to said rod whereby rotational movement of said pin is transformed into vertical movement of said rod; said rod including a first interconnecting rod member having a top and a bottom end, the bottom end being connected to said first pin, a second pin at the top end of said first interconnecting rod member, a second upright rod member connected to said second pin for joint vertical rotation with said first interconnecting rod member, said first and second rod member having a length which is no greater than 34% of the length of said cradle body, and a pivot connecting said foot portion to said second upright rod member, whereby vertical movement of said second rod member is transmitted to said cradle body, and an extensible bellows extending over at least exposed portions of said firt and second rod members whereby said vertically moving rod is encased for safety.

9. A rocking cradle comprising, in combination, spring mounting means adapted to be supported on a floor and providng a pivot which is vertically displaceable against the spring force of the spring mounting means, a cradle body supported on the pivot of the spring mounting means, the cradle body having a top head portion, an intermediate seat portion and a bottom foot portion, the cradle body being shaped to hold a baby having a center of gravity in a predetermined position with said center of gravity approximately directly above said pivot; and rocking means mechanically coupled to the foot portion of the cradle body and causing the cradle to pivot about the vertically displaceable pivot by imparting generally vertical reciprocating motion to the foot portion of the cradle body.

10. The rocking cradle defined in claim 9, the spring mounting means comprising a bent spring frame having a first lower horizontal part, extending from the latter a bent curved intermediate part making substantially a U-turn in the frame, and extending out from the latter a cantilevered second upper horizontal part, the vertically displaceable pivot being provided at the end of the cantilevered second horizontal part, the inherent elasticity of the bent spring frame providing said spring force.

11. The rocking cradle defined in claim 10, the bent curved intermediate part of said bent spring frame being located beneath the head portion of the cradle, the first and second horizontal parts of the bent spring frame extending out from the bent part thereof in the direction from the head portion towards the foot portion of the cradle.

12. The rocking cradle defined in claim 9, the pivot being so located that substantially all the weight of the cradle and the baby supported therein is borne by the spring mounting means, and furthermore borne by the spring mounting means in particular at the location of the pivot, whereby the rocking means need not provide substantial upwards support force resisting the downwards weight of the cradle and the baby supported therein but need only generate rocking force.

13. The rocking cradle defined in claim 10, the bent spring frame being of hollow tubular construction.

* * * * *